US006701110B2

(12) United States Patent
Ono

(10) Patent No.: US 6,701,110 B2
(45) Date of Patent: Mar. 2, 2004

(54) IMAGE FORMING APPARATUS HAVING CHANGE-OVER TYPE DEVELOPING DEVICE

(75) Inventor: Toru Ono, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/286,815

(22) Filed: Nov. 4, 2002

(65) Prior Publication Data

US 2003/0091370 A1 May 15, 2003

(30) Foreign Application Priority Data

Nov. 14, 2001 (JP) ..... 2001-348834
Sep. 18, 2002 (JP) ..... 2002-271680

(51) Int. Cl.[7] ..... G03G 15/01
(52) U.S. Cl. ..... 399/226; 399/54; 399/227
(58) Field of Search ..... 399/9, 82, 85, 399/226, 227, 53, 54; 358/448

(56) References Cited

U.S. PATENT DOCUMENTS 5,121,163 A * 6/1992 Muramatsu et al. ..... 399/39
5,918,087 A * 6/1999 Kimura et al. ..... 399/69
5,991,569 A * 11/1999 Sugihara et al. ..... 399/227
6,047,146 A * 4/2000 Ito et al. ..... 399/54
6,327,450 B1 * 12/2001 Ito ..... 399/227

FOREIGN PATENT DOCUMENTS

JP 03256069 A * 11/1991 ..... G03G/15/01
JP 10268606 A * 10/1998 ..... G03G/15/01

* cited by examiner

*Primary Examiner*—Susan S. Y. Lee
*Assistant Examiner*—Ryan Gleitz
(74) *Attorney, Agent, or Firm*—Fitzpatrick, Cella, Harper & Scinto

(57) ABSTRACT

An image forming apparatus includes a latent image bearing member and a developing portion having a plurality of developing devices provided facing the latent image bearing member, as well as an inputting portion for inputting an image signal, an auto-discriminating portion for automatically discriminating the kind of image input, and a control portion for changing between a first mode for executing monochrome image formation, a second mode for executing color image formation, and an auto-selecting mode for changing over between the first mode and the second-mode according to the discrimination of the auto-discriminating portion. In the auto-selecting mode, movement of a predetermined developing device to a predetermined position is started before the auto-discriminating portion makes the discrimination.

18 Claims, 10 Drawing Sheets

STRUCTURAL EXAMPLE I
HOME POSITION (HP)

STRUCTURAL EXAMPLE II
HOME POSITION (HP)

STRUCTURAL EXAMPLE I
HOME POSITION (HP)

BLACK DEVELOPING POSITION

YELLOW DEVELOPING POSITION

MAGENTA DEVELOPING POSITION

CYAN DEVELOPING POSITION

STRUCTURAL EXAMPLE II
HOME POSITION (HP)

IMAGE FORMING APPARATUS HAVING CHANGE-OVER TYPE DEVELOPING DEVICE

BACKGROUND OF THE INVENTION

1. Field of the Invention

The present invention relates to an image forming apparatus comprising a latent image bearing member and developing means having a plurality of developing devices and provided opposite the latent image bearing member at a predetermined developing position.

2. Related Background Art

Various types of conventional color image developing apparatuses are known. A developing step common to these various types of apparatuses involves separating an original image either into three colors of yellow, magenta and cyan, or four colors, additionally including black, and forming an electrostatic latent image for each color on a latent image bearing member (e.g., a photosensitive drum 202, (as shown in FIG. 1). Each electrostatic latent image then is developed with toner by a developing device of a corresponding color. In this developing step, the developing device of each color executes the developing operation at a position adjacent to (or in contact with) the latent image bearing member. In one type of system, the developing devices of all the colors are disposed adjacent to the latent image bearing member; in another type of system, a developing device change-over portion sequentially brings the developing devices of the corresponding colors into the vicinity of (or into contact with) the latent image bearing member.

Various systems for changing over the developing devices, including a slide mounting system, a rotary drum system (also referred to as a rotary color developing system), and the like are known, with the rotary drum system being common. Referring to FIG. 1, in the rotary drum system a stepping motor (not show) rotates a rotary color developing device 203 around a rotation shaft 200 so as to selectively bring a predetermined developing device 221 to 224 adjacent to or in contact with the latent image bearing member 202. The developing devices 221 to 224 selectively are provided according to the separated color to be developed. Therefore, compared with the configuration in which the developing devices of respective colors are disposed around the photosensitive drum, this configuration is advantageous in that it permits a reduction in size of the apparatus, and establishes a common architecture for the developing devices. The common architecture for the developing devices permits individual replacement of the developing devices as process cartridges, thus reducing toner supply problems and achieving a significant cost reduction.

However, in the rotary drum system, the rotary color developing device 203 takes time to rotate when the developing devices change over. This change-over time is greater than the processing time of the slide-mounting system. This disadvantage significantly influences, in particular, First Copy Output Time (FCOT), that is the time for outputting the first sheet of paper from the start of image formation in a rotary drum system having all four colors (yellow, magenta, cyan, black) mounted in a rotary color developing device for monochrome or color development.

For example, in the case of a rotary color developing device 203 with the developing devices of black, yellow, magenta, and cyan mounted in this order, a developing operation is executed by rotating the rotary color developing device 203 around the rotation shaft 200, with a rotary stepping motor, so as to selectively bring a predetermined developing device of the color to be developed initially to a developing position adjacent to (or in contact with) the photosensitive drum 202. In the case of monochrome development, the initial color is black, and in the case of color development, it is yellow. However, it cannot be determined which of the black or yellow developing devices the rotary color developing device 203 should be switched to until it is determined whether the initial image is a monochrome image or a color image. Therefore, the electrostatic latent image formation start timing is calculated based on the developing device change-over completion scheduled time so that rotation of the rotary color developing device 203 is started after determining whether the original image is a monochrome image or a color image. Thus, the time needed for changing over the developing device delays the electrostatic latent image formation starting time. This limitation has been an obstacle for shortening the FCOT.

SUMMARY OF THE INVENTION

The present invention has been achieved in response to the above-mentioned problems. An object of the present invention is to provide an image forming apparatus comprising a latent image bearing member and a developing portion having a plurality of developing devices, wherein the real average value of the FCOT is shortened by starting movement of a predetermined developing device to a predetermined position before determining the kind of input image.

Specifically, in a color image forming apparatus using a rotary drum type developing device change-over system having a latent image bearing member and a plurality of developing devices, such as a color electrophotography copying machine or a color electrophotography printer, the real average value of the FCOT is reduced by preliminarily rotating the rotary color developing device to a predetermined position at the time an image formation start command is received.

Moreover, the real average value of FCOT is reduced in an image forming apparatus comprising a latent image bearing member and a developing device having a plurality of developing devices provided opposite the latent image bearing member. Such an apparatus provides, an input portion for inputting an image signal, an auto-discriminating portion for automatically discriminating the kind of input image, and a control portion having a first mode for executing monochrome image formation, a second mode for executing color image formation, and an auto-selecting mode for changing over between the first mode and the second mode according to the determination of the auto-discriminating portion. In the case where the auto-selecting mode is selected, the control portion is capable of controlling initial movement of a predetermined developing device to a predetermined position before the auto-discriminating portion makes the determination. At the time image formation is started in the auto-selecting mode, the developing device can be brought into the vicinity of the developing position by preliminarily rotating the developing device changeover portion to a standby position. This preliminary movement reduces the real average value of FCOT. The developing device then is rotated through the remaining angle to the developing position of the developing device after it is determined whether the image to be formed is a monochrome image or a color image.

Alternatively, the control portion may have a first mode for executing image formation using a first developing device, a second mode for executing image formation without using the first developing device, and an auto-selecting mode for changing over between the first mode and the second mode according to the determination of the auto-discriminating portion. In the case the auto-selecting mode is selected, the control portion is capable of controlling initial movement of a predetermined developing device to a predetermined position before the auto-discriminating portion makes the determination. At the time image formation is started in the auto-selecting mode, the developing device can be brought into the vicinity of the developing position by preliminarily rotating the developing device change-over portion to a standby position. This preliminary movement reduces the real average value of FCOT. The developing device then is rotated through the remaining angle to the developing position of the developing device according to the kind of image to be formed.

Moreover, since the standby position can be set by an operator or set automatically according to the frequency of use of monochrome and color by the image forming apparatus, the real average value of the FCOT can be reduced according to the use conditions.

Furthermore, the real average value of FCOT can be reduced in an image forming apparatus which uses toners of different concentrations and components depending on the mode because the control portion initiates movement of a predetermined developing device to a predetermined position before the kind of input image is determined.

For example, the user can set the apparatus in monochrome or color mode based on which one is used most frequently, and the standby position corresponding to the selected mode is selected accordingly. Again, the rotary color developing device is rotated preliminarily, and the real average value of the FCOT is reduced. Other objects, advantages and characteristics of the present invention will become apparent from the description and the drawings below.

DETAILED DESCRIPTION OF THE PREFERRED EMBODIMENTS

Figure 1:
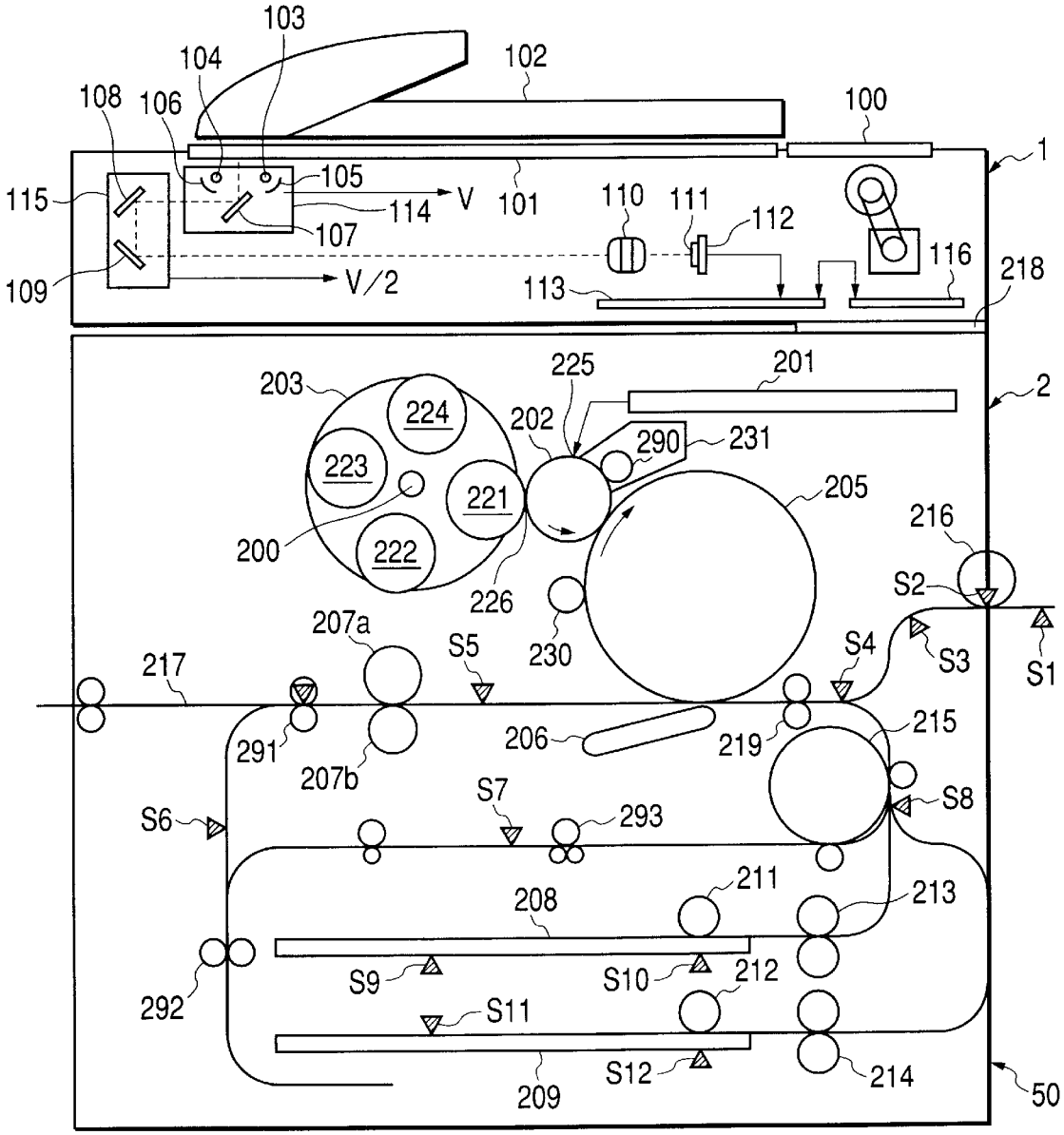
FIG. 1 is a schematic cross-sectional view showing the entire schematic configuration of a color image forming apparatus according to an embodiment of the present invention.

Hereinafter, with reference to the accompanying drawings, a color image forming apparatus 50 of an embodiment of the present invention will be explained. In the drawings, members designated by the same reference numerals represent the same members, Therefore, redundant explanation will be omitted.

FIG. 1 is a schematic cross-sectional view of the color image forming apparatus 50. The color image forming apparatus 50 comprises a color image reader portion 1 (hereinafter referred to as the "reader portion 1") in the upper part, and a color image printer portion 2 (hereinafter referred to as the "printer portion 2") in the lower part.

First, the configuration of the reader portion 1 will be explained. The reader portion includes an original glass stand (platen) 101 and an auto original feeder (also referred to as the ADF) 102. A configuration which includes a mirror surface pressure plate or a white pressure plate (not shown) instead of the ADF 102 can also be employed. As light sources 103, 104 for illuminating the original, a halogen lamp, a fluorescent lamp, or a xenon lamp can be used. The reader portion also includes reflective troughs 105, 106 for condensing respective light beams from the light sources 103, 104 onto an original; mirrors 107, 108, 109; and a lens 110 for condensing a reflected light beam or a projected light beam from the original onto a CCD (charge coupled device) image sensor (hereinafter referred to as the CCD) 111. A substrate 112 on which the CCD 111 is mounted, a control portion 100 for controlling the entire image forming apparatus, and a digital image processing portion 113 also correspond to the 500 series portion excluding the CCD 111 in FIG. 7 and the portions designated by the numerals 401, 402 in FIG. 8. A carriage 114 holds the light sources 103, 104, the reflective troughs 105, 106, and the mirror 107. A carriage 115 holds the mirrors 108, 109. The carriage 114 is moved at a speed V, and the carriage 115 is moved mechanically at a speed V/2 in the sub-scanning direction Y orthogonal to the electrical scanning direction (the main scanning direction X) of the CCD 111 so as to scan the entire surface of the original. An external interface (I/F) interfacing with the other devices 116 is connected electrically with the digital image processing portion 113.

Next, the configuration of the printer portion 2 will be explained. A printer control I/F 218 receives a control signal from a CPU 301 of the control portion 100 described later. Printer portion 2 operates based on the control signal it receives from the printer control I/F 218. A photosensitive drum 202 is rotated counterclockwise. An electrostatic latent image is formed on the photosensitive drum 202 by a laser scanner 201. Developing devices 221, 222, 223, 224 corresponding to black, yellow, magenta, and cyan colors, respectively, are disposed around the rotation shaft 200. To form a toner image on the photosensitive drum 202, when a color image is being formed, a developing operation is executed. In this developing operation, rotary color developing device 203 is rotated around rotation shaft 200 by rotation of a stepping motor (not shown) such that a predetermined developing device of the developing devices 221 to 224 is selectively brought into a developing position adjacent to (or in contact with) the photosensitive drum 202. The developing device is selected according to the separated color to be developed. The developing devices 221 to 224 supply an amount of toner corresponding to the charge on the photosensitive drum 202, so as to develop the electrostatic latent image on the photosensitive drum 202.

In this embodiment, developing devices 221 to 224 are mounted to the rotary color developing device 203 such that they are easily detachable. In the rotary color developing device 203, installation positions corresponding to the black, yellow, magenta, and cyan colors, respectively, are designated in the clockwise direction. The developing devices 221 to 224 of respective colors are mounted at the designated color positions. When a black monochrome image is to be formed, only the black developing device 221 is used. The rotary developing device 203 is rotated so as to bring a sleeve (not shown) of the black developing device 221 into a position opposite the photosensitive drum 202 for toner supply. When developing a full color image, all of the developing devices 221 to 224 are used. The rotary color developing device 203 is rotated so as to bring the sleeve of each developing device into a developing position 226 opposite the photosensitive drum 202 in the order of black, yellow, magenta and cyan. A toner image formed on the photosensitive drum 202 is transferred onto an intermediate transfer member 205 rotating in the clockwise direction, consistent with rotation in the counterclockwise direction of the photosensitive drum 202. The transfer onto the intermediate transfer member 205 is completed in one revolution of the intermediate transfer member 205 in the case of a black monochrome image, and in four revolutions of the intermediate transfer member 205 in the case of a full color image. When forming an image of a sheet size of A4 size or less, two images can be formed on the intermediate transfer member 205.

A sheet (recording paper) picked up by a pickup roller 211 or 212 from an upper stage cassette 208 or a lower stage cassette 209 and fed by a feed roller 213 or 214 is transported to a registration roller 219 by a transport roller 215. At a timing when transfer onto the intermediate transfer member 205 is completed, the sheet begins passing between the intermediate transfer member 205 and a transfer belt 206. Thereafter, the sheet is transported by the transfer belt 206 and pressed on the intermediate transfer member 205 so that the toner image on the intermediate transfer member 205 is transferred onto the sheet. The toner image transferred onto the sheet is pressed and heated by a fixing roller 207*a* and a pressure roller 207*b* so as to be fixed on the sheet. The sheet with the image fixed thereon is delivered to a face up delivery port 217.

Residual toner remaining on the intermediate transfer member 205, that is, toner which is not transferred onto the sheet, is cleaned off of the intermediate transfer member 205 during post process control in the latter half of the image formation sequence. In post process control, the residual toner on the intermediate transfer member 205, after finishing transfer onto the sheet, is charged to a polarity opposite the original toner polarity by a cleaning roller 230 in FIG. 1, as the waste toner, so that the residual toner having the opposite polarity is transferred again on the photosensitive drum 202. In the photosensitive drum unit, the opposite polarity residual toner is scraped off the drum surface by a blade (not shown) and then transported to a waste toner box 231 provided integrally in the photosensitive drum unit. Thus, the residual toner on the intermediate transfer member 205 is cleaned completely, thereby finishing post process control.

In FIG. 1, the printer portion 2 further includes a manually-inserted-sheet trailing edge detecting sensor S1, a manually-inserted-sheet presence or absence sensor S2, an intermediate plate position sensor S3, an ante-registration sensor S4, a separation jamming sensor S5, an inverter sensor S6, a duplex sensor S7, a re-feed sensor S8, an upper stage second sheet absence sensor S9, an upper stage sheet absence sensor S10, a lower stage second sheet absence sensor S11, a lower stage sheet absence sensor S12, a manually-inserted-sheet feed roller 216, a charger 290, fixing delivery rollers 291, inverter rollers 292, and duplex rollers 293.

Figure 2:
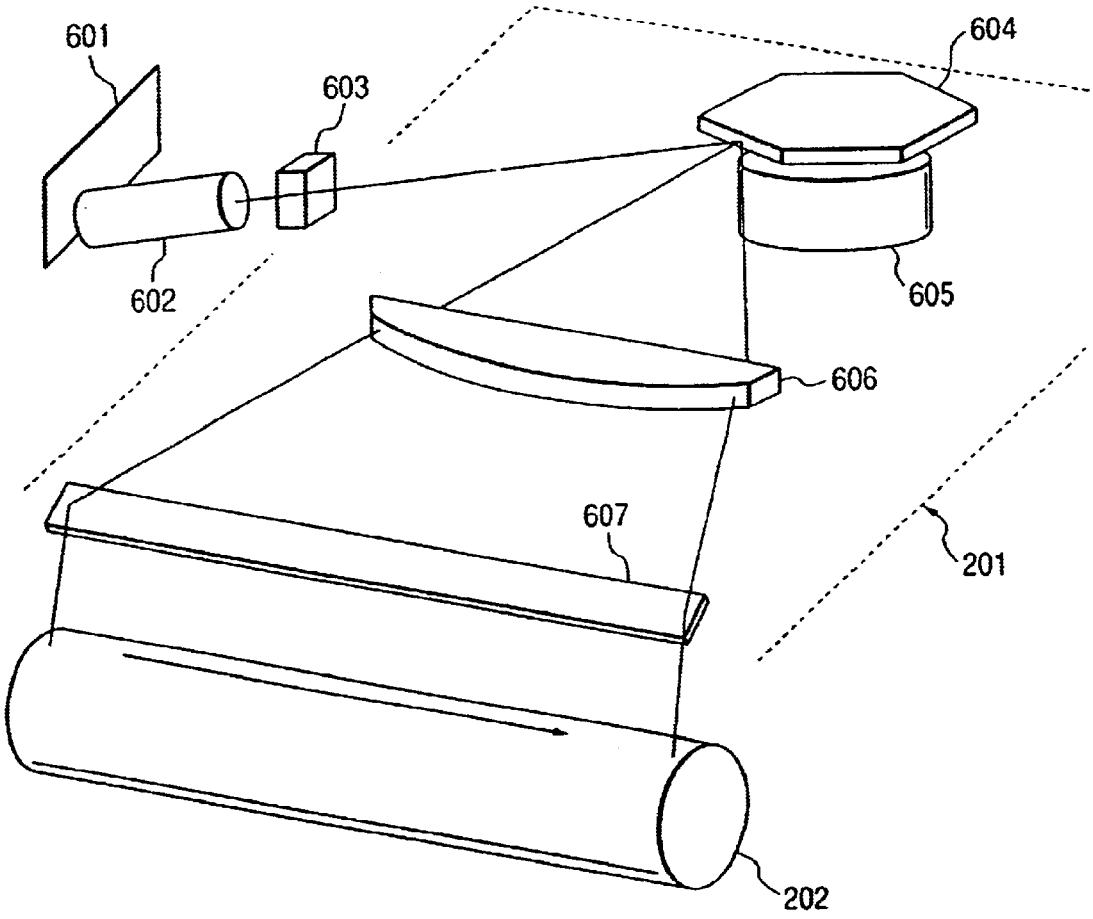
FIG. 2 is a perspective view showing the essential part configuration of a light writing optical system.

FIG. 2 is a diagram showing the schematic configuration of a laser scanner 201. A laser beam corresponding to an image data signal output from a laser driver circuit substrate 601 and transformed to a parallel light beam by a collimator lens 602 and a cylindrical lens 603 enters into a polygon mirror 604 rotating at a constant speed by a scanner motor 605. The laser beam reflected by the polygon mirror 604 is irradiated onto the photosensitive drum 202 via an objective lens 606 disposed in front of the polygon mirror 604 and a reflection mirror 607 for scanning in the main scanning direction.

Figure 3:
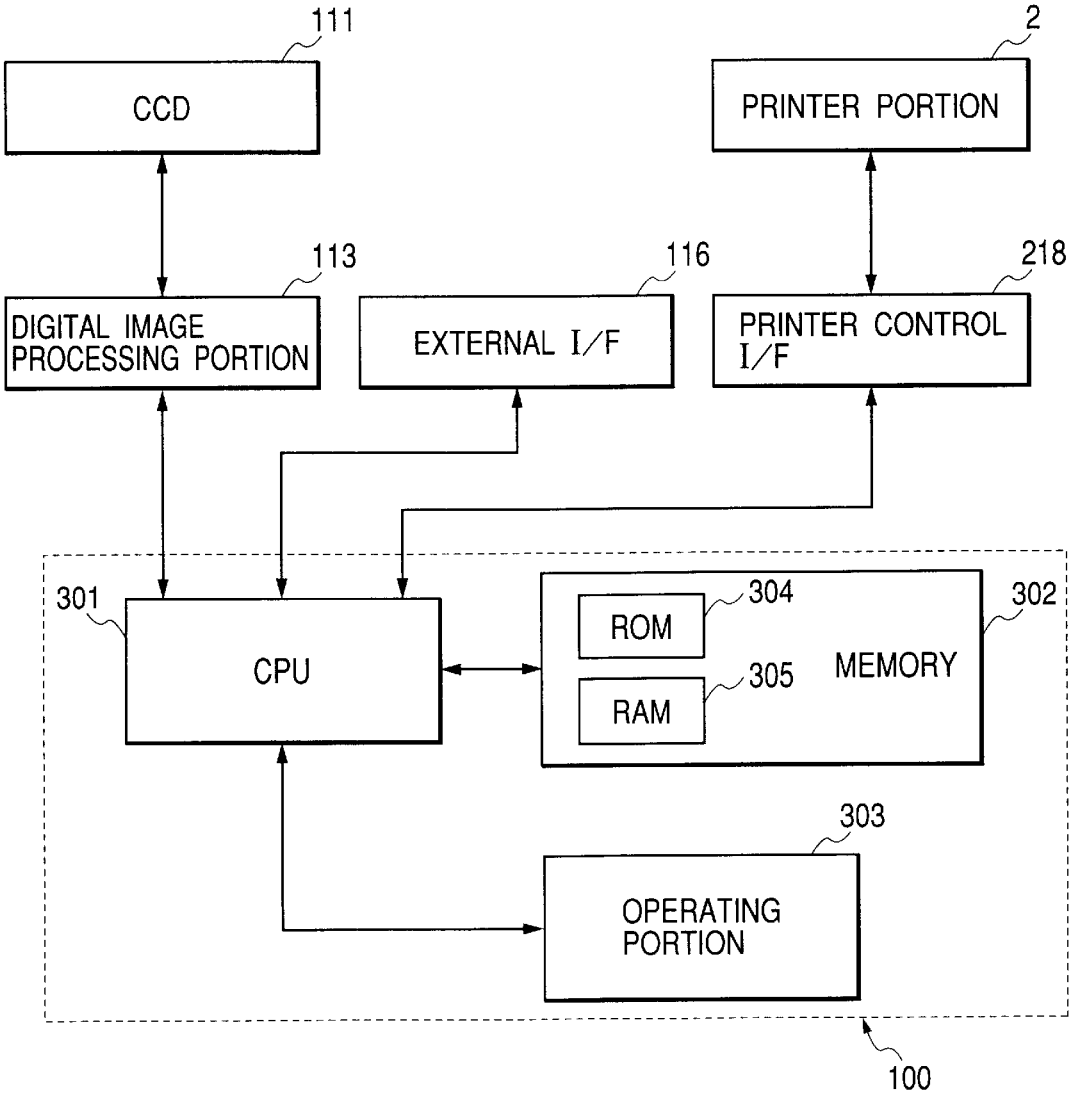
FIG. 3 is a block diagram showing the essential part configuration of a control portion.

FIG. 3 is a block diagram showing the essential part configuration of the control portion 100. The control portion 100 comprises a digital image processing portion 113, a CPU 301 having an interface I/F for exchanging information for control with a printer control I/F 218 and an external I/F 116 and an operating portion 303, and a memory unit 302. The memory unit 302 comprises a RAM 305 for transferring work area data to the CPU 301, and a ROM 304 for storing a control program for the CPU 301. The ROM 304 stores a control program for executing operation modes described later, such as the automatic color selecting (ACS) mode for automatically changing over between color image formation and the black and white image formation, the color image forming mode (also referred to as the color mode), and the black and white image forming mode. The ROM 304 also stores a control program for controlling the entire image forming apparatus 50. The operating portion 303 comprises a liquid crystal display with a touch panel for displaying process execution content input and other information warnings, or the like concerning the process.

Figure 4:
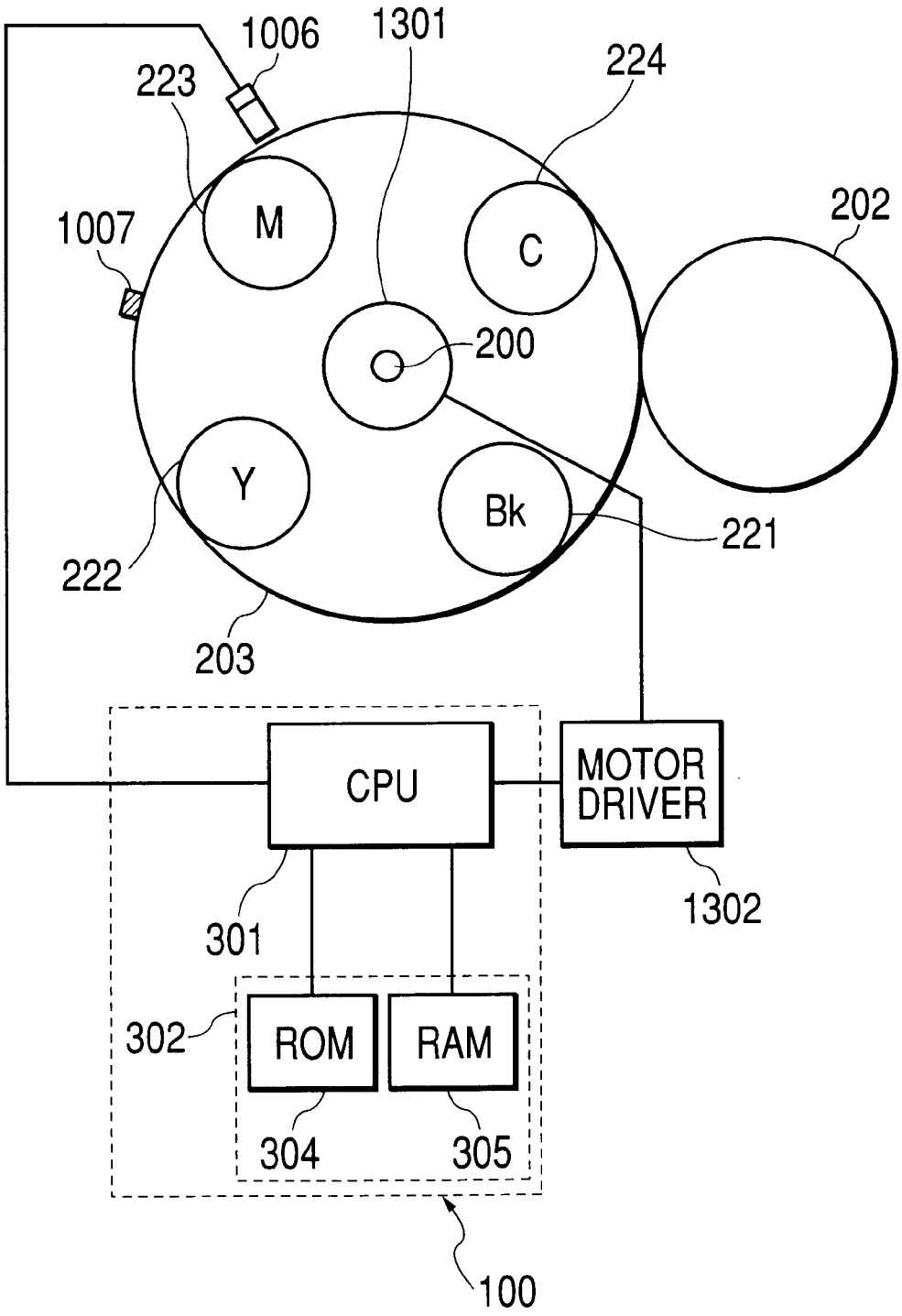
FIG. 4 is a diagram showing the relationship between a rotary color developing device and a control portion.

FIG. 4 is a block diagram showing the configuration of a control circuit of the rotary color developing device 203. A developing operation is executed whereby the rotary color developing device 203 is rotated around the rotation shaft 200 by rotation of the stepping motor 1301 so as to selectively bring the developing devices 221 to 224 into a developing position in contact with (or adjacent to) the photosensitive drum 202. The developing device is selected according to the separated color to be developed. The control circuit of the rotary color developing device 203 comprises a stepping motor 1301, a motor driver 1302, a CPU 301 for a main body controlling portion 100, a memory unit 302 having a ROM 304 and a RAM 305, and an optical sensor 1006. The CPU 301 of the main body control portion 100 outputs a pulse to the motor driver 1302 for controlling the stepping motor 1301 when rotating the rotary color developing device 203. Moreover, the program stored in the ROM 304 of the main body control portion 100 determines the rotating operation state, the home position (hereinafter referred to as the "HP"), and the stopping position according to a relationship between the pulse output and detection of the home position flag 1007 by the optical sensor 1006.

Figure 5:
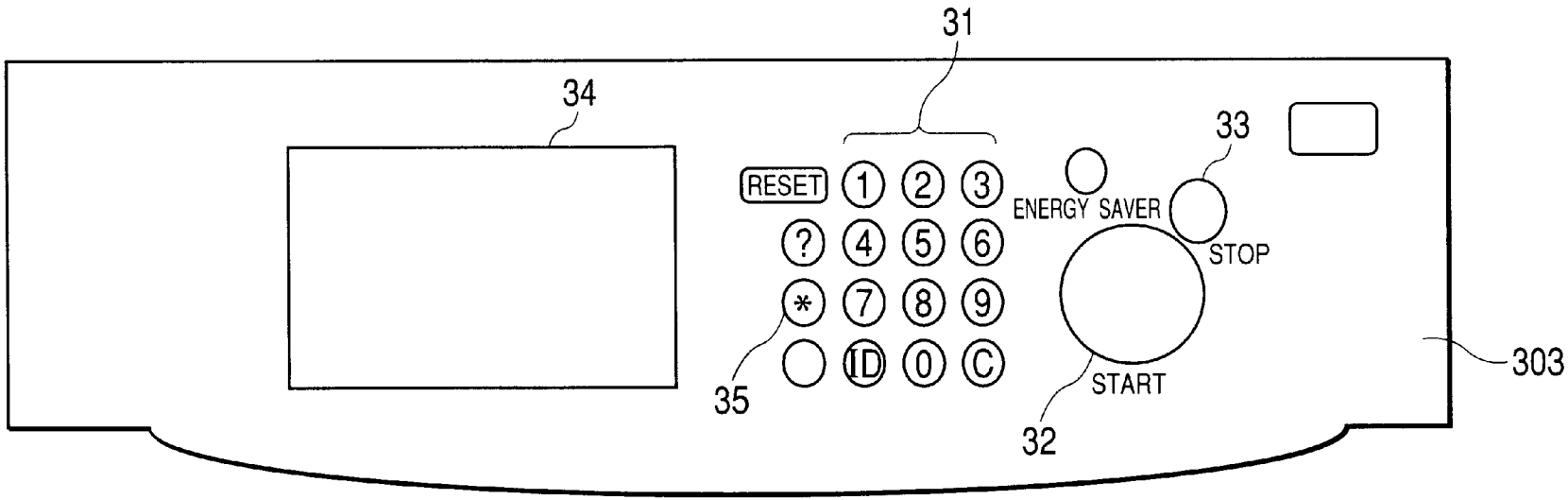
FIG. 5 is a diagram showing the configuration of an operating portion 303.

FIG. 5 is a diagram showing the configuration of the operating portion 303. The operating portion 303 comprises a ten key number pad 31, a start key 32, a stop key 33, an LCD 34, and a user mode key 35. Here, the ten key number pad 31 includes keys which allow the user to input the number of copies, the image moving amount at the time of copying, or the like. The user presses key 32 to start a copying job. The user presses key 33 to stop a job in progress. The LCD 34 is a display portion for displaying the operation state of the image forming apparatus 50. Further, the LCD 34 is provided with a panel switch which allows the user to set the job mode.

The user presses mode key 35 in order to display the user mode screen on the LCD 34. In the user mode screen, the user can set a standard operation of the copying machine, including the specifications for every function of the image forming apparatus 50. For example, the user can set the mode to be selected as the standard mode (default) if the user does not expressly designate a mode. One mode is the automatic color selecting (ACS) mode described later, which changes over between color image formation and black and white image formation depending on whether the image to be formed is a color image or a black and white image. Other modes include the color image forming mode (also referred to as the color mode), and the black and white image forming mode (also referred to as the black and white mode). In the user control screen, the user can also set the paper size as longitudinal or lateral if the paper size at the time of the black and white image formation is a non-fixed size paper. In the automatic color selecting mode, if the paper size is non-fixed, the operator can use the user mode screen to determine whether the paper size (longitudinal and lateral) is input initially or at the time the color original is detected.

Figure 6:
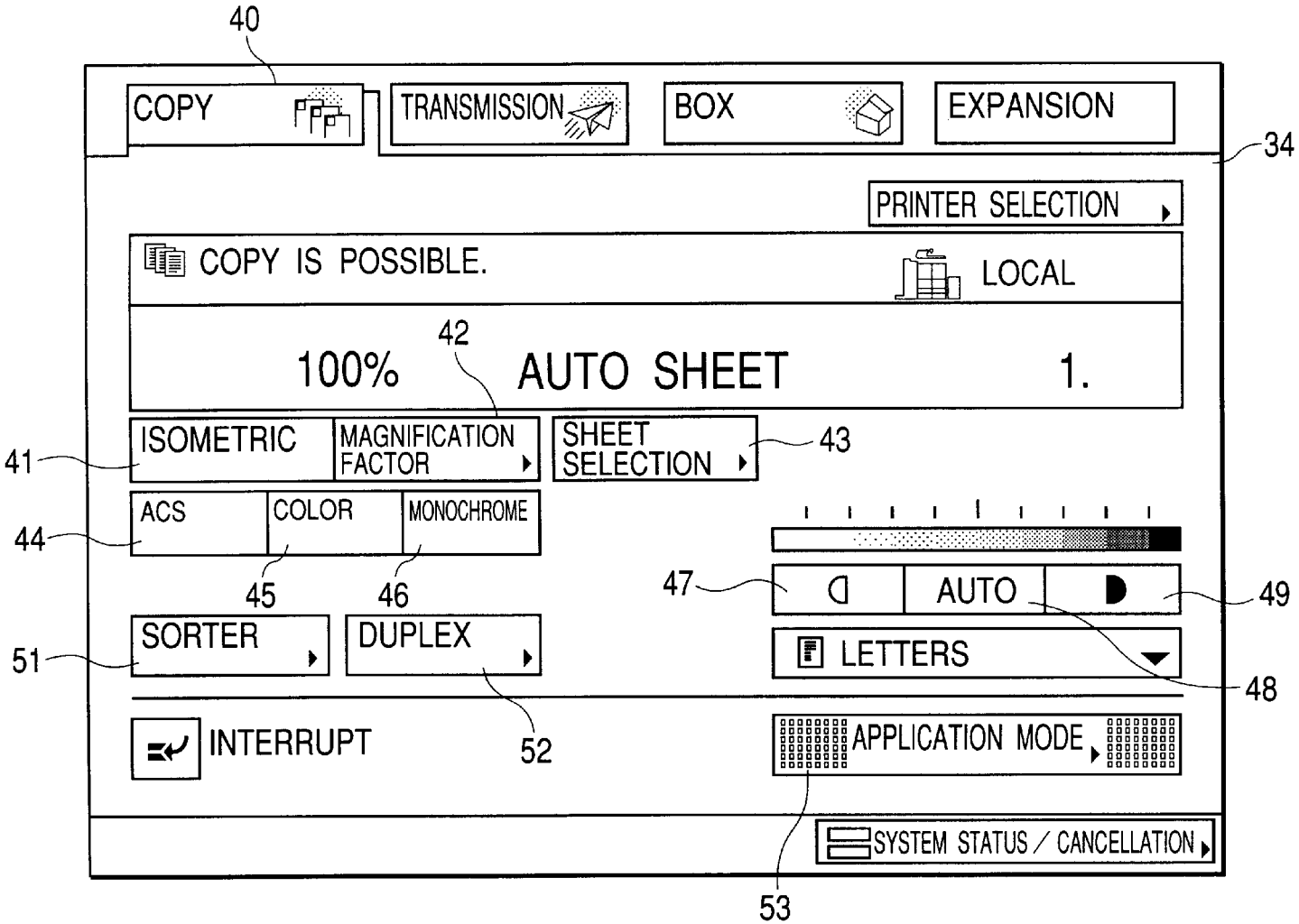
FIG. 6 is a diagram showing the standard screen of an LCD on an operating portion.

FIG. 6 is a diagram showing the display screen in the standard state of the LCD 34. In the "copy " screen 40, numerals 41, 42 designate buttons for setting the magnification at the time of image formation. Numeral 43 designates a paper size selecting button for selecting the paper size (such as one of various kinds of standard sizes, and non-fixed size papers). Numerals 44, 45, 46 designate buttons for executing the automatic color selecting (ACS) mode, the color image forming mode, and the black and white image forming mode, respectively. Only one button can be selected at a time. Numerals 47, 48, 49 designate buttons for adjusting the printing density of the image. Numeral 51 designates a button for designating other processes, such as stapling or other finishing processes , that are executed on the recording paper stack in the delivery paper processing device (not shown). Numeral 52 designates a button for selecting how the image is to be arranged (copy type). Copy types include: from one side to one side, from one side to two sides, from two sides to one side, and from two sides to two sides. Numeral 53 designates a button for selecting among various application modes.

Figure 7:
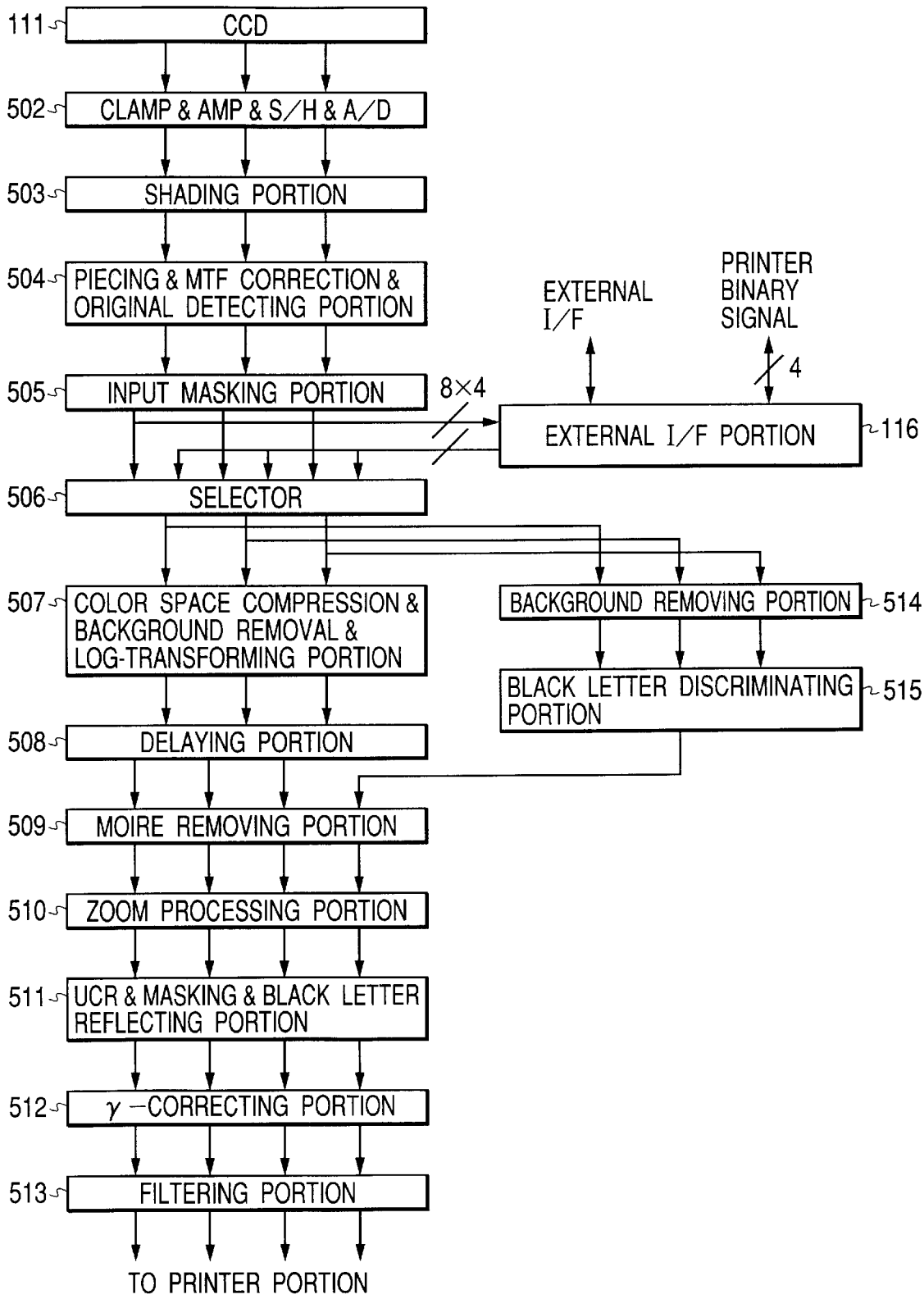
FIG. 7 is a diagram showing the essential part configuration of a digital image processing portion.

FIG. 7 is a block diagram showing the detailed configuration of the digital image processing portion 113 on FIG 1. An original on the original glass stand 101 (to be explained in detail) reflects light from light sources 103, 104 so that the reflected light is guided to the CCD 111 and transformed into an electric signal (in the case the CCD 111 is a color sensor, it may have RGB color filters mounted on a one line CCD in the order of R, G, and B by inline, or it may have a three line CCD with an R filter, a G filter and a B filter arranged for each CCD, or it may have a filter on-chip, or it may have a filter independent from the CCD). Then, the electric signal (analog image signal) is input to the digital image processing portion 113, sample-held (S/H) by a Clamp & Amp & S/H & A/D portion 502, with the dark level of the analog image signal clamped to the reference potential. The signal is amplified to a predetermined amount (the above-mentioned processing order is not limited to the order of description), and A/D transformed into, for example, an 8-bit digital signal for RGB. Then, the RGB signals are processed for the shading correction and black correction in a shading portion 503. Then, in the case the CCD 111 is a three line CCD, since the reading position in the piecing process differs between the lines, the delay amount is adjusted in a Piercing and MTF Correction and Original Detecting Portion 504, which corrects the signal timings so that the reading position is the same for the three lines. Each line is adjusted according to the reading rate. Since the reading MTF differs depending on the reading rate and the magnification ratio in the MTF correction, the change is corrected. In the original detection, the original size is recognized by scanning the original on the original glass stand 101. The digital signals with the corrected reading position timing are used by the input masking portion 505 to correct the spectral characteristics of the CCD 111 and the spectral characteristics of the light sources 103, 104 and the reflective troughs 105, 106. The output from the input masking portion 505 is input to a selector 506 and is switchable to an external I/F signal. The signal output from the selector 506 is input to a Color Space Compression & Background Removal & LOG Transforming Portion 507 and a background removing portion 514. After having the background eliminated, the signal input to the background removing portion 514 is input to a black letter discriminating portion 515, which detects black letters in the original in order to produce a black letter signal from the original. In addition, the color space compression is determined in the Color Space Compression & Background Removal & LOG Transforming Portion 507, after the other output from the selector 506 has been input. The color space compression is determined according to whether the image signal is within a range that can be reproduced by the printer. In the case it is within the range, it is left as it is, and in the case it is out of the range, the image signal is corrected so as to be within the range that can be reproduced by the printer. Then, the background removing process is carried out, and the image signal is transformed from an RGB signal to a YMC signal in the LOG Transforming Portion. In order to correct the timing of the signal produced in the black letter discriminating portion 515, the timing of the output signal from the Color Space Compression & Background Removal & LOG Transforming Portion 507 is adjusted in the Delaying Portion 508. The two kinds of signal undergo a moiré elimination process in a Moiré Removing Portion 509, and are zoom-processed in the main scanning direction in a Zoom Processing Portion 510. The signal processed in the Zoom Processing Portion 510 is input to a UCR and Masking and Black Letter Reflecting Portion 511. A YMCK signal is produced from the YMC signal by the UCR process so as to be corrected into a signal according to the output of the printer in the masking processing portion. A discriminating signal produced in the Black Letter Discriminating Portion 515 is fed back to the YMCK signal. The signal processed in the UCR & Masking & Black Letter Reflecting Portion 511 is density-adjusted in a γ Correcting Portion 512, then undergoes a smoothing or edge process in a Filtering Portion 513. The processed signal is transmitted to the Printer Portion 2.

Figure 8:
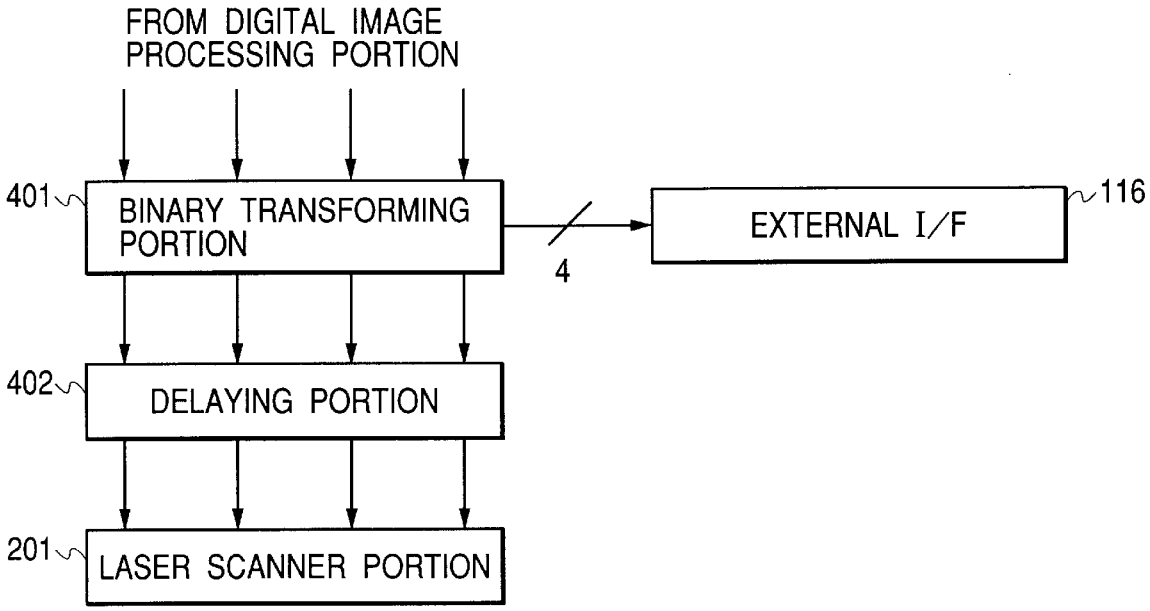
FIG. 8 is a block diagram showing the essential part configuration of a printer processing portion.

FIG. 8 is a diagram showing the process after receipt in the Printer Portion 2 of the signal processed in the digital image processing portion. The received eight-bit multi-value signal is transformed into a binary signal in a Binary Transforming Portion 401. For the transforming method, any of a dither method, an error diffusion method, an improved error diffusion, or the like can be used. The transformed binary signal is transmitted to the external I/F 116 and the Delaying Portion 402. In the external I/F 116, as needed, the received signal is transmitted to an external output device such as a facsimile (not shown). In order to correct the received signal and the laser light emission timing of the laser scanner portion 201, the Delay Portion 402 adjusts the timing for transmission to the Laser Scanner Portion 201.

FIGS. 9A, 9B, 9C, 9D, 9E and 9F are diagrams showing respective stopping positions of the rotary color developing device 203. The rotary color developing device 203 is maintained at a predetermined rotation position, that is, at the HP position 701, except at the time of image formation. The HP position 701 is a position with the visualizing portion 226 disposed between the black developing device 221 and the cyan developing device 224. In the case the rotary color developing device 203 is rotated to the HP position, the CPU 301 uniformly rotates the stepping motor 1301 via the motor driver 1302 such that the rotary color developing device 203 is moved to the HP position (FIG. 9A) by rotating the motor in predetermined pulses. The rotation begins at the time the optical sensor 1006, mounted in the vicinity of the rotary color developing device 203, detects the home position flag 1007.

The home position detecting operation for moving the rotary color developing device 203 to the HP position (FIG. 9A) is executed each time the power source of the image forming apparatus 50 is switched on, the apparatus is switched from the low power consumption mode to normal operating mode, the front door cover (not shown) of the image forming apparatus 50 is closed after correcting a jamming process, or the like, or the black developing process finishes during image formation.

At the time of the home position detecting operation, even in the case pulses corresponding to one revolution are transmitted to the stepping motor 200 for rotating the rotary color developing device 203, if the optical sensor 1006 does not detect the home position flag 1007, the rotating operation of the rotary color developing device 203 is determined to be abnormal by the program stored in the ROM 304 of the main body control portion 100. The detection result output from the optical sensor 1006 is transmitted to the CPU 301 of the main body control portion 100, as shown in FIG. 4. The pulse transmission to the stepping motor 200 for rotating the rotary color developing device 203 is transmitted from the CPU 301 of the main body controlling portion 100 to the motor driver 1302 for controlling the stepping motor 200.

Figure 9A:
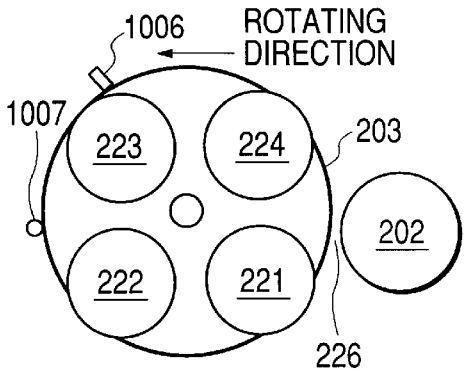
FIGS. 9A, 9B, 9C, 9D, 9E and 9F are diagrams showing the stopping positions of a rotary color developing device.

Finally, details of the control of the rotary color developing device 203, which are characteristic of this embodiment, will be explained with reference to FIGS. 9A to 9F, and FIG. 10. The image forming apparatus 50 shown in this embodiment prepares the image modes, which include the color mode, the black and white mode, and the auto color select (ACS) mode. The ACS mode changes over between color image formation and black and white image formation depending on whether the original image is a color image or a black and white image. It automatically recognizes whether the original image is monochrome or colored when the original is read by the reader portion 1, and executes the image forming process in the black and white mode (also referred to as the monochrome mode) in the case the original image is monochrome, and in the color mode in the case the original image is colored. Here, the process in the ACS mode will be explained. When the operator presses the copy starting button 32 in the operating portion 303, a reading operation for the original placed on the original glass stand 101 is started in the reader portion 1 and the image forming operation starting command (S801) is transmitted to the printer portion 2. Receipt of this command starts the drive of the photosensitive drum 202 and the peripheral units (such as the intermediate transfer member 205) in the printer portion 2. At this time, it is determined whether or not the image forming mode is the ACS mode (S802). In the case it is not the ACS mode, the rotary color developing device 203 is on stand by at the HP position (FIG. 9A). Thereafter, when the image forming preparations are made in the printer portion 2, the image information is transmitted from the reader portion 1. It is determined whether the received image information is monochrome or colored (S807). In the case the original image is black monochrome, the rotary color developing device 203 is rotated counterclockwise to the black developing position (FIG. 9B) (S808) so as to change over the developing device. In order to visualize the electrostatic latent image by adhering a toner, the rotary color developing device 203 should be rotated to the black developing position (FIG. 9B) before the electrostatic latent image formed at the laser irradiating position 225 reaches at the visualizing position 226 in which the photosensitive drum 202 and one of the sleeves of the developing devices 221 to 224 are opposite each other. That is, the electrostatic latent image formation starting time should be after the time calculated by the following formula:

(Time T1 for completing the rotation of the rotary color developing device 203 from the HP position (FIG. 9A) to the black developing position (FIG. 9B))−(Time T2 needed for moving the electrostatic latent image from the laser irradiating position 225 to the visualizing position 226).

Figure 9B:
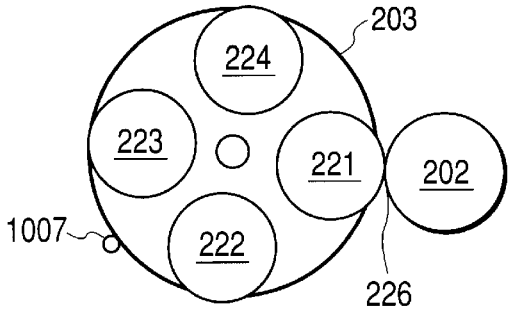
Figure 9C:
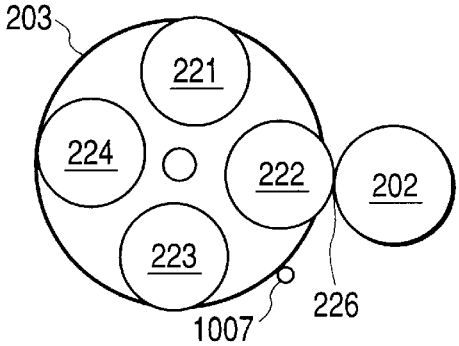
Figure 9D:
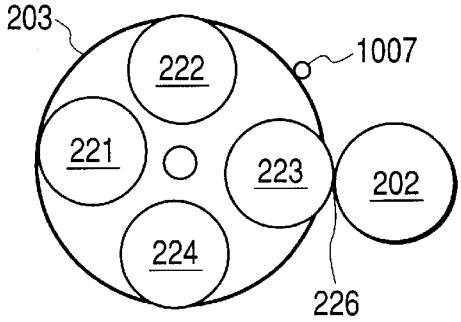
Figure 9E:
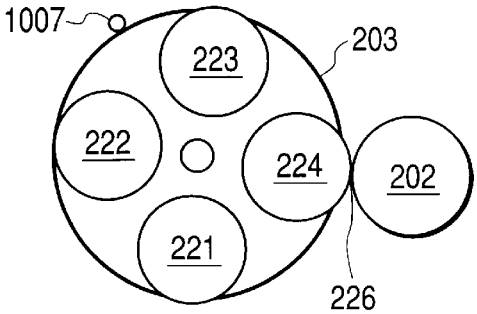

In contrast, in the case the original image is colored, the rotary color developing device 203 is rotated counterclockwise from the HP position (FIG. 9A) to the yellow developing position (FIG. 9C) (S809) so as to be rotated successively to the magenta developing position (FIG. 9D), the cyan developing position (FIG. 9E), and the black developing position (FIG. 9B). In this case, the electrostatic latent image formation starting time should be after the time calculated by the following formula:

(Time T3 for completing the rotation of the rotary color developing device 203 from the HP position (FIG. 9A) to the yellow developing position (FIG. 9C))−(Time T2 needed for moving the electrostatic latent image from the laser irradiating position 225 to the visualizing position 226).

In the above-mentioned example, the developing device is changed over by rotating the rotary color developing device 203 from the HP position (FIG. 9A) to the black developing position (FIG. 9B) (S808) or to the yellow developing position (FIG. 9C) (S809) at the time the original image color is determined to be monochrome or colored (S807). At this time, the above-mentioned times satisfy the below-mentioned relationship:

$$T1>T2, T3>T2,$$

Thus, the rotation time of the rotary color developing device 203 shown by T1 and T3 is the obstacle in shortening the FCOT.

In order to overcome this problem, in the case of the ACS mode (S802), when the operator presses down the copy starting button 32 in the operating portion 303, the rotary color developing device 203 is rotated from the HP position (FIG. 9A) to the black developing position (FIG. 9B) (S803) so as to be on standby thereat. Then, in the case the original image is black monochrome (S805), the electrostatic latent image formation is started immediately (S810). In contrast, in the case the original image is colored, the rotary color developing device 203 is rotated counterclockwise from the black developing position (FIG. 9B) to the yellow developing position (FIG. 9C) (S806), so that the electrostatic latent image formation is started at the time the rotation is completed (S810).

Thereby, the rotation time of the rotary color developing device 203 is shortened to zero in the case the original image is black monochrome, and to the rotation time from the black developing position (FIG. 9B) to the yellow developing position (FIG. 9C), in the case the original image is color. Thus, the electrostatic latent image formation starting timing can be made earlier and the real average value of the FCOT can be reduced.

(Other Embodiments)

Figure 9F:
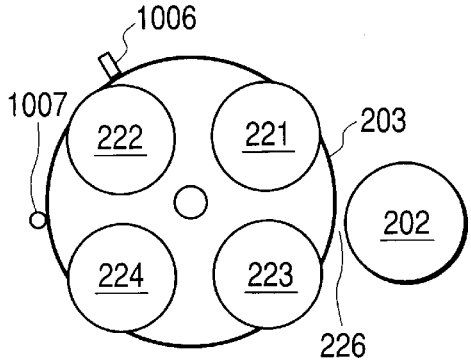
Figure 10:
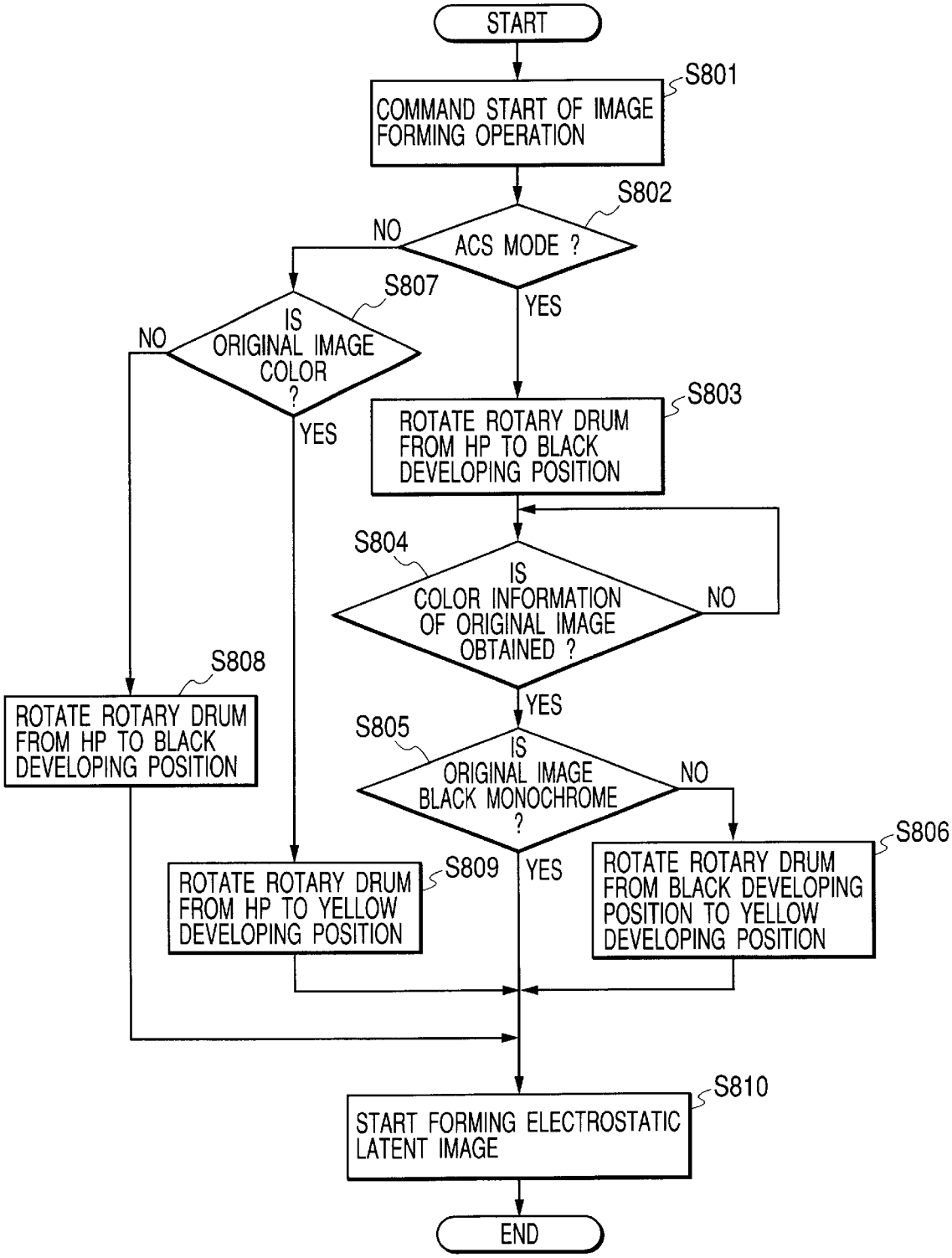
FIG. 10 is a chart showing the flow of control.

Although the mounting order of the developing devices is set in the order of black, yellow, magenta, and cyan in the clockwise direction, as shown in the structural example I (FIG. 9A) in this embodiment, so as to have the developing order of yellow, magenta, cyan, and black in the case the original image is colored, the mounting order of the developing devices and the developing order are not particularly limited thereto. For example, as shown in the structural example II (FIG. 9F), the mounting order can be magenta, cyan, yellow, and black in the clockwise direction, with the HP position as the visualizing position 226 disposed between the magenta developing device 223 and the black developing device 221 (FIG. 9F). If the developing order is magenta, cyan, yellow, and black, then when the copy starting button is pressed down in the ACS mode, first, the black developing device 221 is rotated from the HP position (FIG. 9F) to the visualizing position 226 in the counter-clockwise direction so as to be on standby thereat. In the case the original image is black monochrome, the electrostatic latent image formation is started immediately. In contrast, in the case the original image is colored, the rotary color developing device 203 is rotated from the black developing position to the magenta developing position, so that the electrostatic latent image formation starts at the rotation completing time. This is effective for shortening the FCOT, particularly in the case the original image is frequently black monochrome. In addition thereto, in the case the original image is frequently colored, first, it is rotated from the HP position to the magenta developing position so as to be on standby thereat. Then, in the case the original image is colored, the electrostatic latent image formation is started immediately. In contrast, in the case the original image is black monochrome, the rotary color developing device 203 is rotated from the magenta developing position to the black developing position so as to start the electrostatic latent image formation at the rotation completing time.

In another configuration, the change-over of the standby position may be set by the operator or set automatically. The change-over method of the standby position will be explained. In the case the operator presses down the user mode key 35, the user mode screen is displayed on the LCD 34 (not shown). In the above-mentioned user mode screen, any of the color image forming mode, the black and white image forming mode, and the ACS mode can be selected. For example, in the case the original image is frequently colored, the operator may designate the color image forming mode as the standby position in the above-mentioned user mode screen. When the copy command is executed under this setting, the rotary color developing device 203 is rotated from the HP position to the magenta developing position so as to be on standby thereat. In the case the original image is colored, the electrostatic latent image formation is started immediately.

In addition, although the image forming mode is explained in this embodiment as the ACS mode, the image forming mode is not limited to the ACS mode. The image forming mode may be the total mode including the monochrome mode and the color mode. This can be adopted in an apparatus with a configuration wherein the copy mode information selected in the reader portion 1 is transmitted to the printer portion 2 until the image information is received.

Further, although the intermediate transfer member 205 is shown as the drum in this embodiment, the intermediate transfer member is not limited to a drum; for example, it may have a belt-like shape. Furthermore, although developing devices of the four colors including black, yellow, magenta, and cyan are provided in the rotary color developing device in this embodiment, the developing devices provided in the rotary color developing device are not limited thereto. For example, the developing devices of the three colors including yellow, magenta, cyan may be provided in the rotary color developing device, and the black developing device may be provided independently in the vicinity of the latent image bearing member. In this case, when the printer portion 2 receives the developing device starting command, the rotary color developing device is rotated to the vicinity of the yellow developing position so as to be on standby thereat. After making a determination as to whether the original image is monochrome or colored, in the case it is black monochrome, the electrostatic latent image formation is started immediately using the black developing device provided independently in the vicinity of the latent image bearing member. In contrast, in the case it is colored, the yellow developing device, being on standby in the vicinity of the yellow developing position, is rotated to the developing position so as to start the electrostatic latent image formation.

Moreover, for example, the developing devices may include the six colors of black, yellow, thick magenta, thin magenta, thick cyan, and thin cyan. In this case, two color modes are provided: a high speed color mode for image formation using the four colors including black, yellow, thick magenta, and thick cyan, and an image quality priority color mode for image formation using the six colors including black, yellow, thick magenta, thin magenta, thick cyan, and thin cyan. The automatic discriminating ACS mode can automatically determine whether the input image is a letter image or a graphic image, and can be set in the user mode screen so as to select the image quality priority color mode when a higher image quality is required. When the printer portion 2 receives the developing device starting command, the rotary color developing device is rotated to the vicinity of the thin magenta developing position, which is used initially in the image quality priority color mode, so as to be on standby thereat. A determination is made as to whether the original image is a letter image or a graphic image. In the case it is a letter image, the rotary color developing device is rotated from the thin magenta developing position to the thick magenta developing position so as to start the electrostatic latent image formation at the time the rotation is completed. In the case the original image is a graphic image, the electrostatic latent image formation is started immediately using the thin magenta developing device.

Further, for example, two black developing devices can be provided: a mono-component black developing device for letters, and a two-component black developing device for graphics. These devices, can be selected according to the mode, that is, the mono-component device can be used by the letter priority mode and the two-component device can be used by the image quality priority mode.

Furthermore, the original image is not limited to a paper original read by the CCD 111 of the reader portion 1; rather, it may be an image from a personal computer connected to the external I/F in FIG. 3. That is, although the process of the image forming operation at the time of the copying operation has been explained in this embodiment, the image forming operation is not limited to the copy operation, and it may occur at the time of the printer operation or the facsimile operation.

What is claimed is:

1. An image forming apparatus comprising:

a latent image bearing member;

a developing portions, having a plurality of developing devices, provided opposite said latent image bearing member;

an input portion for inputting an image signal;

an auto-discriminating portion for automatically discriminating among kinds of input image signals; and a control portion for controlling operation of the image forming apparatus, said image forming apparatus being operable in:

a first mode for executing monochrome image formation;

a second mode for executing color image formation; and an auto-selecting mode for changing over between said first mode and said second mode in accordance with a discrimination by said auto-discriminating portion, wherein, when said image forming apparatus is operating in the auto-selecting mode, said control portion starts to move a predetermined developing device of said plurality of developing devices to a predetermined position before said auto-discriminating portion makes the discrimination.

2. An image forming apparatus according to claim 1, wherein said predetermined developing device is used in the first mode.

3. An image forming apparatus according to claim 1, wherein said predetermined developing device is a developing device to be used initially in the second mode.

4. An image forming apparatus according to claim 1, wherein said control portion further moves a developing device different from said predetermined developing device to a developing position according to the discrimination.

5. An image forming apparatus according to claim 1, wherein said plurality of developing devices are disposed around a rotation shaft in said developing portion, and said developing portion is rotated about the rotation shaft to bring a desired developing device of said plurality of developing devices into a developing position opposite said latent image bearing member to perform a developing operation.

6. An image forming apparatus according to claim 1, wherein when a developing device to be used initially in the mode selected by the discrimination of said auto-discriminating portion is different from said predetermined developing device, said control portion moves said developing device to be used initially in the selected mode into a developing position.

7. An image forming apparatus according to claim 1, wherein said auto-discriminating portion discriminates whether the input image is a monochrome or color image signal.

8. An image forming apparatus according to claim 1, wherein said control portion selects said predetermined developing device according to a setting set by an operator, and wherein said control portion starts to move said predetermined developing device before said auto-discriminating portion makes the discrimination.

9. An image forming apparatus according to claim 1, wherein said control portion selects said predetermined developing device, according to the frequency of use in the first mode and the frequency of use in the second mode of said image forming apparatus, and starts to move said predetermined developing device before said auto-discriminating portion makes the discrimination.

10. An image forming apparatus according to claim 1, wherein said developing portion is provided with a black developing device.

11. An image forming apparatus comprising:

a latent image bearing member;

a developing portion, having a plurality of developing devices, provided opposite said latent image bearing member;

an input portion for inputting an image signal;

an auto-discriminating portion for automatically discriminating among kinds of input image signals; and a control portion for controlling operation of said image forming apparatus, said image forming apparatus being operable in:

a first mode for executing image formation using a first developing device;

a second mode for executing image formation without using said first developing device; and an auto-selecting mode for changing over between the first mode and the second mode in accordance with a discrimination by said auto-discriminating portion, wherein, when said image forming apparatus is operating in the auto-selecting mode, said control portion starts to move a predetermined developing device of the plurality of developing devices to a predetermined position before said auto-discriminating portion makes the discrimination.

12. An image forming apparatus according to claim 11, wherein said predetermined developing device is used in the first mode.

13. An image forming apparatus according to claim 11, wherein said predetermined developing device is a developing device to be used initially in the second mode.

14. An image forming apparatus according to claim 11, wherein at least one developer contained in said first developing device of said plurality of developing devices is a mono-component developer.

15. An image forming apparatus according to claim 11, wherein said control portion selects said predetermined developing device according to a setting set by an operator, and starts to move said predetermined developing device before said auto-discriminating portion makes the discrimination.

16. An image forming apparatus according to claim 11, wherein said control portion selects said predetermined developing device according to the frequency of use said in the first mode and the frequency of use in the second mode of operation of said image forming apparatus, and starts to move said predetermined developing device before said auto-discriminating portion makes the discrimination.

17. An image forming apparatus according to claim 11, wherein said developing portion has at least one set of developing devices having developers of the same color and different densities.

18. An image forming apparatus according to claim 11, wherein said developing portion has at least one set of developing devices having developers of the same color and different components.

* * * * *

UNITED STATES PATENT AND TRADEMARK OFFICE

CERTIFICATE OF CORRECTION

PATENT NO. : 6,701,110 B2
DATED : March 2, 2004
INVENTOR(S) : Toru Ono

It is certified that error appears in the above-identified patent and that said Letters Patent is hereby corrected as shown below:

Title page,
Item [56], References Cited, FOREIGN PATENT DOCUMENTS,
"03256069" should read -- 3-256069 -- and
"10268606" should read -- 10-268606 --.

Column 13,
Line 4, "portions," should read -- portion, --.

Column 14,
Line 50, "said" should be deleted.

Signed and Sealed this

Twenty-first Day of September, 2004

JON W. DUDAS
*Director of the United States Patent and Trademark Office*